US007231677B1

(12) United States Patent
Reeves

(10) Patent No.: US 7,231,677 B1
(45) Date of Patent: Jun. 19, 2007

(54) ROLL-UP BLANKET WITH STRAPS AND METHOD OF USE

(76) Inventor: Brian M. Reeves, 2 Black Cherry St., Ladera Ranch, CA (US) 92694

( * ) Notice: Subject to any disclaimer, the term of this patent is extended or adjusted under 35 U.S.C. 154(b) by 0 days.

(21) Appl. No.: 11/329,333

(22) Filed: Jan. 9, 2006

(51) Int. Cl.
*A47G 9/06* (2006.01)

(52) U.S. Cl. ..... 5/419; 5/417; 5/485; 297/229

(58) Field of Classification Search ..... 5/417–420, 5/413 R, 485, 490, 494; 297/229
See application file for complete search history.

(56) References Cited

U.S. PATENT DOCUMENTS 2,264,471 A * 12/1941 Glenn ..... 5/419
4,844,540 A * 7/1989 Pegram ..... 297/229
4,914,767 A 4/1990 Balicki et al.
5,361,435 A 11/1994 Reeves
5,384,923 A 1/1995 Hwang et al.
D377,879 S 2/1997 Walden
5,730,529 A 3/1998 Fritz et al.
5,774,912 A * 7/1998 Dominique ..... 5/419
5,920,931 A 7/1999 Zuehlke et al.
6,182,309 B1 2/2001 Sullivan
6,223,367 B1 * 5/2001 French et al. ..... 5/419
2004/0019968 A1 * 2/2004 Vlassis et al. ..... 5/413 R

FOREIGN PATENT DOCUMENTS

WO WO 02/17756 A1 3/2002

* cited by examiner

*Primary Examiner*—Michael Trettel
(74) *Attorney, Agent, or Firm*—Gene Scott, Patent Law & Venture Group

(57) ABSTRACT

A rectangular flexible fabric sheet has mounted corner holders. A horizontally oriented support is engaged with the corner holders for securing the sheet so as to enable a person to recline on the sheet. A pillow having a circular fabric outer cover is positioned at one end of the sheet. The pillow is split into two portions sharing the outer cover; each one of the portions providing a planar fabric inner panel. The inner panels share a common edge functional as a hinge enabling the two portions to assume an unfolded attitude wherein the inner panels lie abutting the sheet for supporting the neck and head of the reclining person, and a folded attitude wherein the inner panels mutually abut and thereby provide a more robust pillow.

20 Claims, 4 Drawing Sheets

ROLL-UP BLANKET WITH STRAPS AND METHOD OF USE

CROSS-REFERENCE TO RELATED APPLICATIONS

This application is a substitute application of a prior filed and now abandoned application having Ser. No. 10/808,765 and filing date of Mar. 24, 2004.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to blankets, and more particularly to roll-up blankets with straps.

2. Description of Related Art Including Information Disclosed Under 37 CFR 1.97 and 1.98

Walden, U.S. Des. 377,879 describes a combined lounging mat and compartmented pillow with carrying handle and roll-up straps design. Sullivan, U.S. Pat. No. 6,182,309 describes A beach towel-pillow apparatus allowing a user to rest comfortably on a beach towel while his or her head is supported by a cylindrically-shaped pillow, permanently affixed to one end of the towel portion of the apparatus. One or more elastic securing straps are affixed to one end of the apparatus and are used to secure the towel portion when it is wrapped around the pillow thereby allowing for easy storage and transporting of the apparatus. An adjustable carrying strap, much like a belt, is affixed to one end of the pillow allowing for a user to sling the carrying strap over his or her shoulder for easy carrying of the apparatus once the towel has been secured around the pillow by the securing straps. A pillow covering with a zipper hidden from view by a portion of the covering encloses the pillow, allowing for easy insertion and removal of the pillow. Balicki et al., U.S. Pat. No. 4,914,767 describes a beach blanket having a perimeter and a plurality of tabs of hook and loop type material attached to and spaced about the perimeter. A pillow has matching tabs of hook and loop type material on one side of the pillow for attaching the pillow to any one of the tabs of hook and loop type material on the blanket. The pillow may be inflatable. Sand clamps are used to hold down the blanket. Each of the sand clamps has a spike with a point at one end and a spring-biased clamp section on the spike. Reeves, U.S. Pat. No. 5,361,435 describes a portable beach towel with a built-in hidden pouch for storing valuables. The towel comprises an elongated rectangular fabric portion having top and bottom surfaces, top and bottom end edges, and side edges. A pair of elastic loops and a carrying strap are sewn onto the bottom surface near the bottom edge. A pocket is formed by folding the top end edge over the top surface, thereby defining an enclosure space for holding an elongated rod-shaped pillow made from a soft, compliant material. An access aperture between the top end edge and the top surface opens into the pouch, which is sewn into the pocket. The aperture can be closed with a zipper or other suitable type of closure. In use, with the towel resting upon the ground, the access aperture is normally hidden from view from passers by. Hwang et al., U.S. Pat. No. 5,384,923 describes an improved camping sleeping mat and/or chair arrangement having improved lateral edge stiffening rod retention pockets and having coupling members for coupling various portions together in various configurations. A separate inflatable pillow may be detachably mounted on the camping sleeping mat and/or chair arrangement. Fritz et al., U.S. Pat. No. 5,730,529 describes a combination beach mat and carrying device. The mat has a pillow section and several storage sections closed by a closure having a flap to protect the closure from sand. Additionally, the mat has securing straps for binding up the mat for easy transportation, and a carrying strap for carrying the bound up contents. The carrying strap is located along the seam of the pillow and mat sections. The securing straps are extended beyond the bounds of the mat to be located out of the way. Zuehlke et al., U.S. Pat. No. 5,920,931 describes a pillow blanket comprising a broad flat pliable sheet and a pocket member onto the broad flat pliable sheet at one corner, with an open mouth of the pocket member facing inwardly on the broad flat pliable sheet. In a first instance, the broad flat pliable sheet when unfolded can be utilized as a blanket. In a second instance, the broad flat pliable sheet when folded up and tucked into the open mouth of the pocket member after the pocket member is turned inside out can be utilized as a pillow and seat cushion.

The related art described above discloses a combined lounging mat and compartmented pillow with carrying handle and roll-up straps, a sun dial beach blanket with pillow, a portable beach towel with security pocket, a sleeping mat and seating arrangement, a combination beach mat and carrying device, and a pillow blanket, but does not teach a blanket apparatus having diagonal straps on its bottom surface for securement of the blanket apparatus to a support device when in use. The present invention fulfills these needs and provides further related advantages as described in the following summary.

BRIEF SUMMARY OF THE INVENTION

This disclosure teaches certain benefits in construction and use which give rise to the objectives described below.

A rectangular flexible fabric sheet has mounted corner holders. A horizontally oriented support is engaged with the corner holders for securing the sheet so as to enable a person to recline on the sheet. A pillow having a circular fabric outer cover is positioned at one end of the sheet. The pillow is split into two portions sharing the outer cover; each one of the portions providing a planar fabric inner panel. The inner panels share a common edge functional as a hinge enabling the two portions to assume an unfolded attitude wherein the inner panels lie abutting the sheet for supporting the neck and head of the reclining person, and a folded attitude wherein the inner panels mutually abut and thereby provide a more robust pillow. The sheet and pillow are capable of being rolled and stored in a back pack type of holder.

A primary objective inherent in the above described apparatus and method of use is to provide advantages not taught by the prior art.

Another objective is to provide such an invention capable of being secured independently at each of four corners to a support device when in use.

A further objective is to provide such an invention capable of being folded to form a cover when in use.

A still further objective is to provide such an invention capable of having a pillow device removably attached.

A further objective is to provide such an invention capable of being rolled and bound as a roll by attached bands when not in use.

A still further objective is to provide such an invention capable of being carried as a roll by an attached handle or in a conforming back pack.

A yet further objective is to provide such an invention with a pillow that may be folded into an open attitude for supporting the neck differentially from the head.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
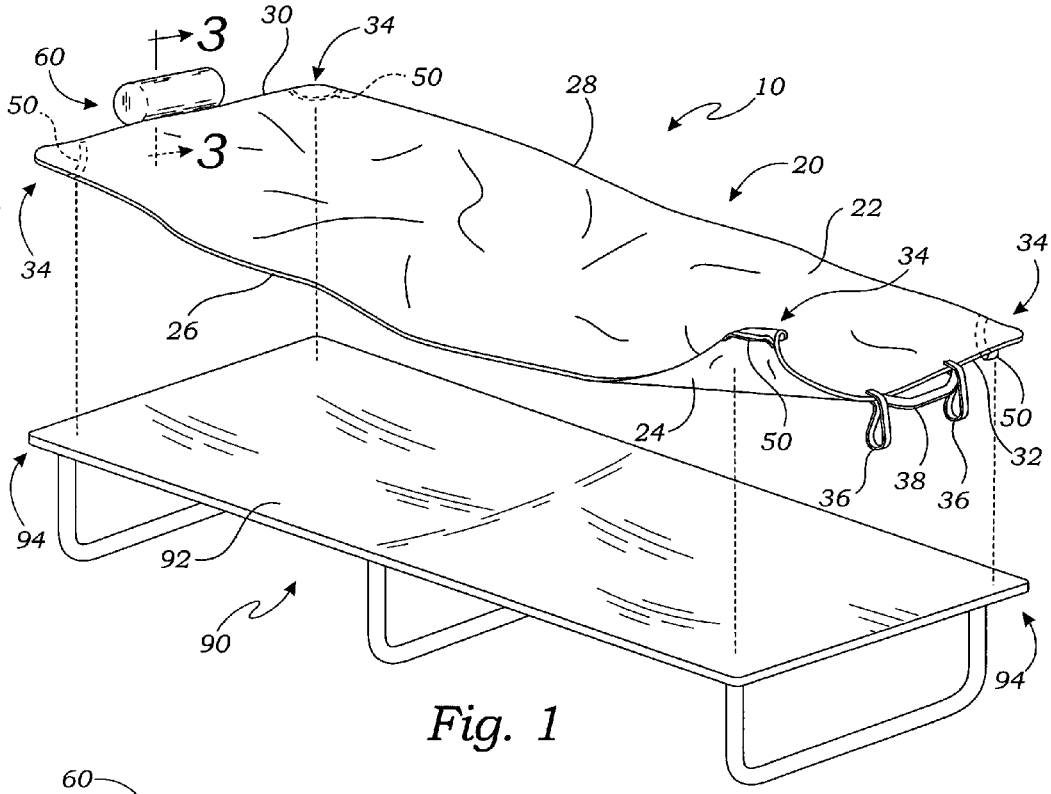
FIG. 1 is a perspective exploded view of an embodiment of the invention shown with a cot.
Figure 2:
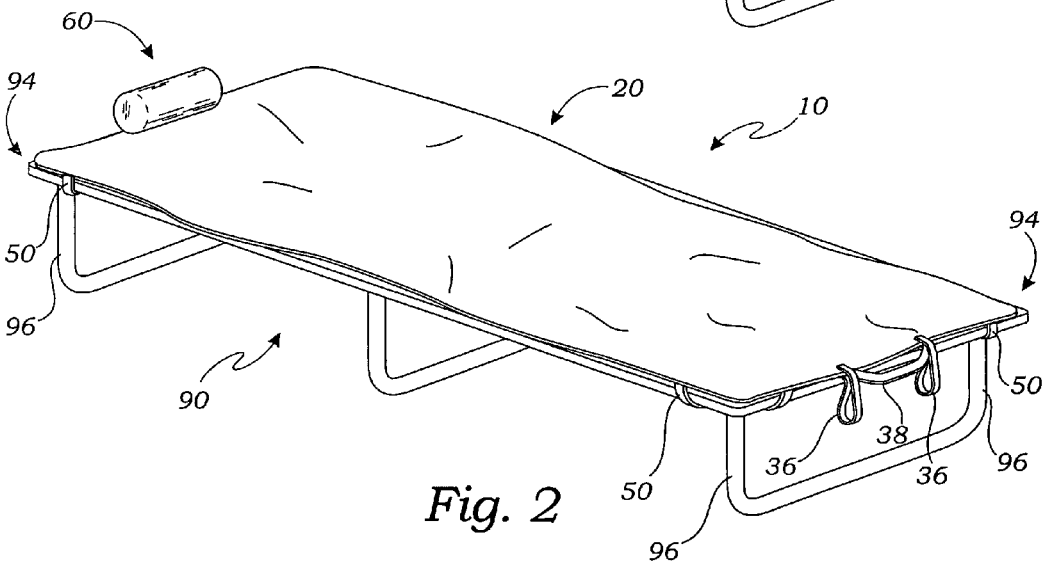
FIG. 2 is a further perspective view thereof as attached to the cot.
Figure 3:
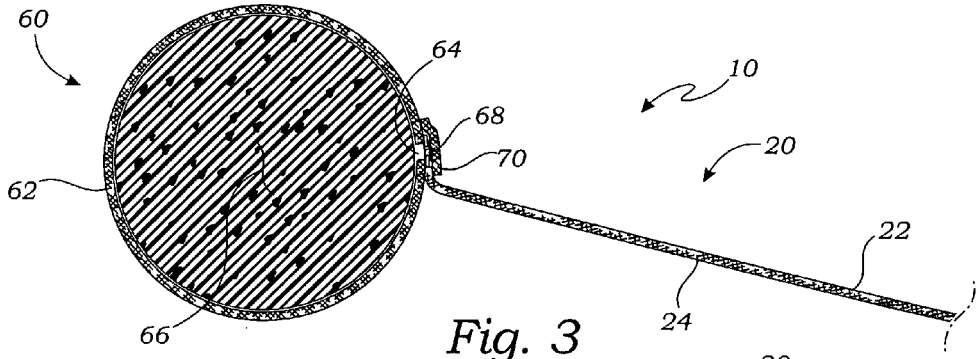
FIG. 3 is a cross-sectional view thereof taken along section line 3—3 of FIG. 1.
Figure 5:
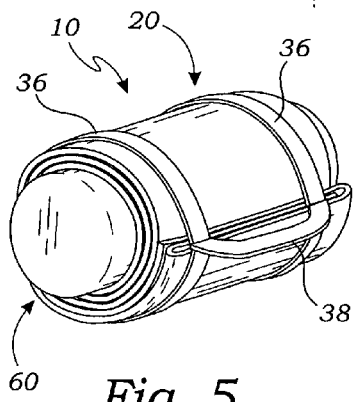
FIG. 5 is a perspective view thereof shown fully rolled and secured.

Described now in detail is a blanket apparatus or flexible fabric sheet 10 shown in FIG. 1, comprising an elongated fabric portion 20 having a top surface 22 and a bottom surface 24 and corner holders 50, which may be diagonal oriented straps and which are referred to as "straps" in this disclosure, attached to the bottom surface 24 at corners so as to provide loops for securement of the sheet 10 to a support 90 such as a cot, when in use. In the exemplary embodiments, the fabric portion 20 is configured to be substantially rectangular so as to have opposite first and second long edges 26 and 28, opposite first and second short edges 30 and 32, and four corners 34. As such, four straps 50 are attached diagonally, substantially at a forty-five degree angle, to the bottom surface 24, one at each of the four corners 34 and such straps or similar structure and positioning has been found to be essential to successfully meeting the objectives of the invention. It will be appreciated by those skilled in the art that numerous other configurations of the fabric portion 20 are possible without departing from the spirit and scope of the invention, such as square, rectangular, oval, circular, and trapezoidal. The fabric portion 20 may be formed from a fleece, cotton, or other fabric suitable for resting on or under. The straps 50 are attached to fabric 20 by stitching at opposing ends of the straps to the bottom surface 24. It will be appreciated that the straps 50 may also be removably attached at one or both ends using snaps, hooks, hook and loop type material, or other such engagement devices now known or later developed. The straps 50 may be of elastic material such as rubber, or braided, knitted or woven cotton, nylon, polypropylene or polyester, and may alternately be relatively inelastic. With continued reference to FIG. 1, at least one securement band 36 is preferably attached at the second short edge 32 such that the fabric portion 20 may be rolled from the first short edge 30 toward the second short edge 32 and secured as a roll by the securement bands 36 when the blanket apparatus 10 is not in use, as explained in more detail below, and as shown in FIG. 5. The bands 36 are shown and described as an elastic material that is attached at both ends to the second short edge 32 so as to form a loop that can be stretched about the rolled fabric portion 20, though it will be appreciated by those skilled in the art that, just as with the straps 50, the bands 36 may be formed from a variety of other materials and attached to secure the fabric portion 20 as a roll, through snaps, hooks, hook and loop type material, or other such engagement devices at one or both ends of the bands 36. A handle 38 is also attached at the second short edge 32 for carrying the blanket apparatus 10 when rolled up and not in use. The handle 38 may be formed from a separate and different material than the bands 36, or the handle 38 and bands 36 may be formed from a single, continuous piece of material attached along the second short edge 32. Again, the handle 38 may be attached by stitching, snaps, hooks, hook and loop type material, or other such engagement devices now known or later developed. The exemplary embodiments of the blanket apparatus 10 further include a pillow 60 attached at the first short edge 30 of the fabric portion 20 as shown in FIGS. 1 and 2. As best shown in FIG. 3 in section, the pillow device 60 includes a sleeve 62 enclosing a resilient core 66. The sleeve 62 is configured as a substantially enclosed tube attached to and extending from the first short edge 30, and the sleeve 62 provides an aperture 64 which enables the core 66 to be inserted into the sleeve 62. The core 66 may be formed from a number of resilient materials such as conventional foam or latex. The aperture 64 is selectively closed through a zipper 68, or snaps, hooks, hook and loop type material, or other such devices now known or later developed, so as to selectively contain the core 66 within the sleeve 62. Thus, if the core 66 is to be removed for laundering the sleeve 62, for example, or replaced due to wear or simply as a matter of material choice, or if no pillow is desired and the core 66 is to be removed altogether, the core 66 is easily accessed within the aperture 64. A flap 70 is attached over the aperture 64 to make the blanket apparatus 10 safer, more comfortable, and more attractive and to conceal and protect the zipper 68.

Figure 4:
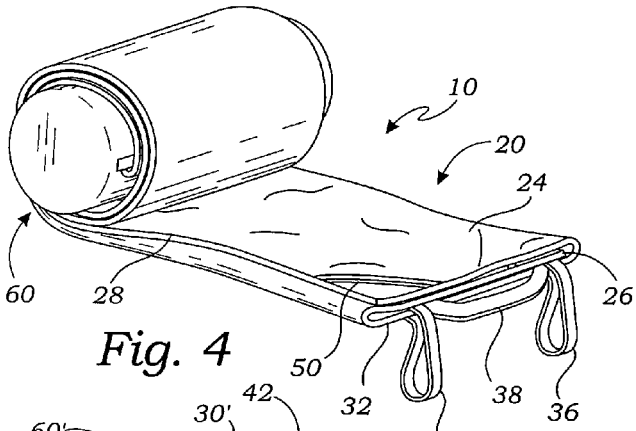
FIG. 4 is a perspective view thereof shown partially rolled.
Figure 11:
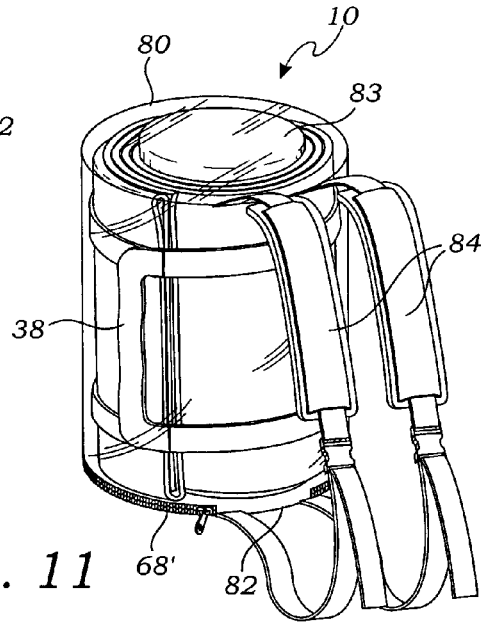
FIG. 11 is a perspective view of the invention as shown in FIG. 5 enclosed within a carrier bag.

In use, as shown in FIG. 2, the blanket apparatus 10 of the present invention is spread over the support 90, such that the bottom surface 24 is laid upon an upwardly-facing support surface 92 (FIG. 1) of the support 90. To temporarily secure the blanket apparatus 10 in position and prevent it from sliding or slipping off the support 90, at least two of the diagonal straps 50 attached to the bottom surface 24 of the fabric portion 20 are hooked about corners 94 of the support 90. It will be appreciated by those skilled in the art that where a cot or other such support device 90 is employed in combination with the blanket apparatus 10, it is advantageous that the support 90 be configured with four corners 94 that extend laterally beyond the legs 96 so that the corners 94 are accessible for the securement of the straps 50 thereunder. With the blanket apparatus 10 so laid on a support 90, the pillow 60 is positioned along the first short edge 30 of the fabric portion 20 so as to be conveniently located for support of a user's head resting on the blanket apparatus 10. If the pillow 60 is not used, the user may simply shift herself toward the second short edge 32 of the fabric portion 20 to position her head clear of the pillow 60. The pillow 60 may also be pivoted about the first short edge 30 so as to hang therefrom out of the way. Or, as explained above, the pillow core 66 may be removed from the pocket 62 altogether. As the blanket apparatus 10 is in use, the bands 36 and the handle 38 simply dangle from the second short edge 32 out of the way of the user resting on the upper surface 22 of the fabric portion 20. When the user is through resting on the blanket apparatus 10 and would like to take the blanket apparatus 10 with her, the user would get up and unhook the straps 50 from under the corners 94 of the support 90. The blanket apparatus 10 can then be rolled up from the first short edge 30 toward the second short edge 32 about the pillow device 60 as shown in FIG. 4. The blanket apparatus 10 is secured as a roll by binding the rolled blanket apparatus 10 with the bands 36 attached at the second short edge 32 as shown in FIG. 5. In the exemplary embodiment, this would be accomplished by stretching the looped bands 36 about the rolled blanket apparatus 10. The user may then carry the rolled blanket apparatus 10 by the convenient handle 38. Alternately, the rolled blanket apparatus 10 may be placed into a carrier 80 as shown in FIG. 11, and transported as a back pack. Preferably, the carrier 80 is of clear plastic material in the form of a cylinder with one end 82 of the cylinder closed by a zipper 68' and has dual shoulder straps 84 mounted in parallel and extending from the one end 82 to the opposing end 83.

In the preferred embodiment, the blanket apparatus 10 is folded along its length prior to rolling. With reference now to FIGS. 4 and 5, the fabric portion 20 has a fabric width defined by the length of the first and second short edges 30 and 32. Furthermore, the pillow 60 is formed having a pillow width that is preferably between one-third and one-half of the fabric width in dimension, the pillow 60 being attached at the first short edge 30 along the pillow width so as to be substantially centered on the first short edge 30. As such, before rolling the blanket apparatus 10, the first and second long edges 26 and 28 of the fabric portion 20 are folded inwardly along the length of the fabric portion 20 so as to configure the blanket apparatus 10 with a folded width of between one-third and one-half the blanket width, or a folded width substantially equal to the pillow width and centered on the pillow 60. In this way, as the folded blanket apparatus 10 is rolled about the pillow 60 toward the second short edge 32, as best shown in FIG. 4, the fabric portion 20 is gathered circumferentially about the pillow 60 to form a compact roll no wider than the pillow 60 itself. When the roll is then bound by the straps 36, as shown in FIG. 5, the straps 50 formed on the bottom surface 24 of the fabric portion 20 are concealed as well, protecting the straps 50 from being inadvertently pulled or damaged when the blanket apparatus 10 is not in use.

Figure 6:
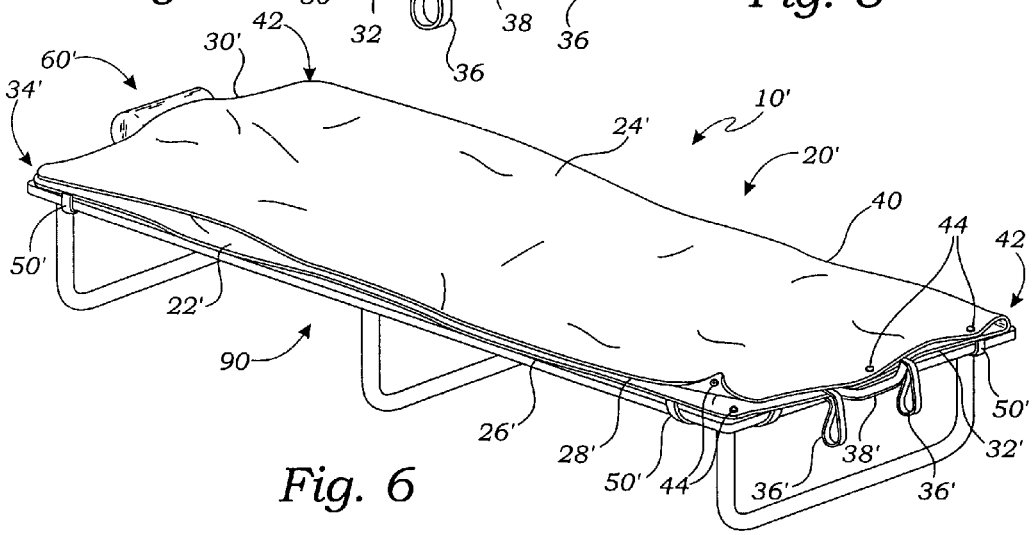
FIG. 6 is a perspective view of an alternative embodiment of the invention as attached to the cot.

Turning now to FIG. 6, we find that in a further preferred embodiment, the fabric portion 20 may be configured having a width essentially double that of the embodiment shown in FIG. 2. In this way, the fabric portion 20 may be folded in half such that the first and second long edges 26 and 28 are substantially adjacent and are offset from an opposite folded edge 40 so as to form a half width defined by the portions of the first and second short edges 30 and 32 between the respective first and second long edges 26 and 28 and the folded edge 40.

Figure 7:
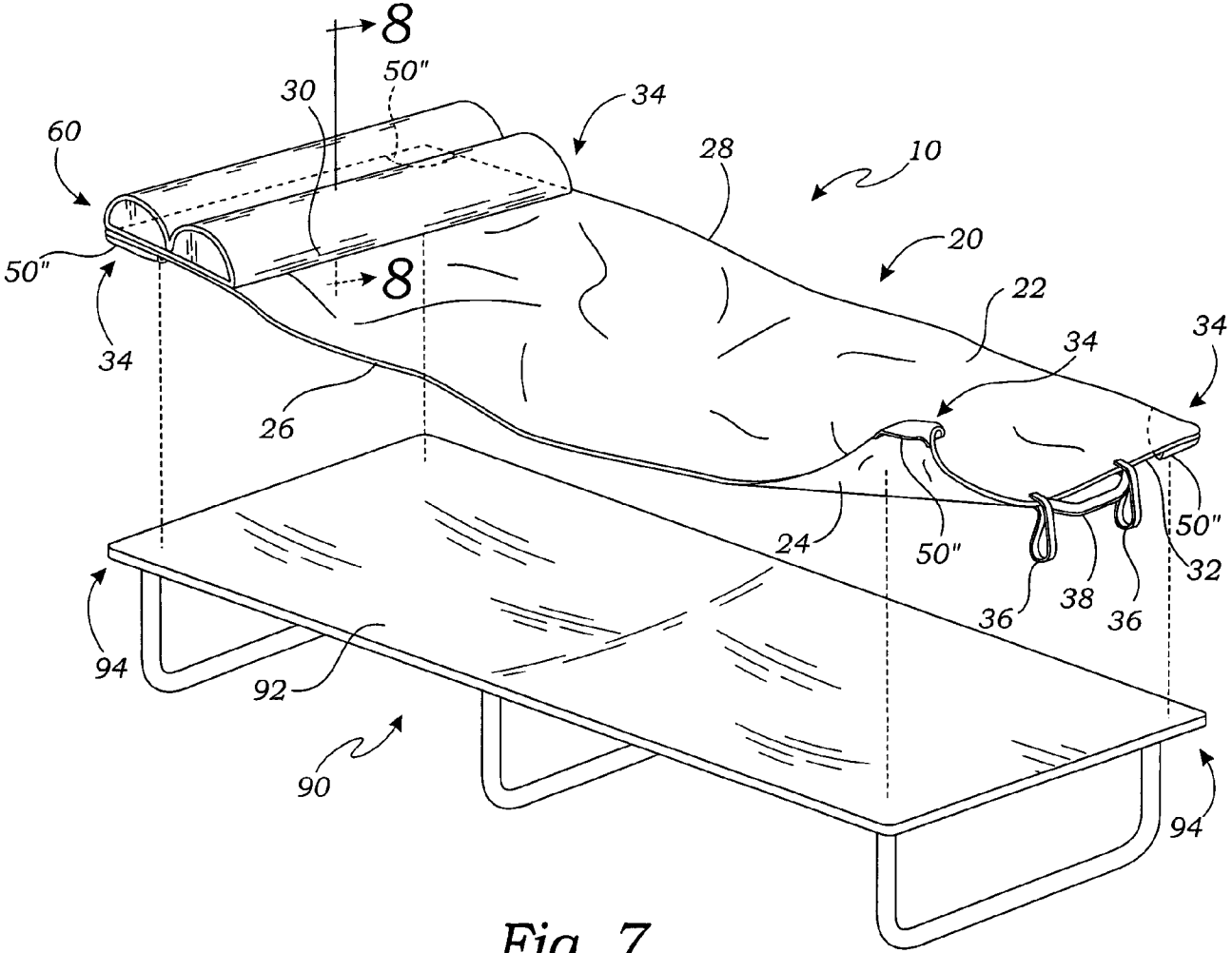
FIG. 7 is an exploded perspective view of a further alternate embodiment of the invention shown with the cot.
Figure 8:
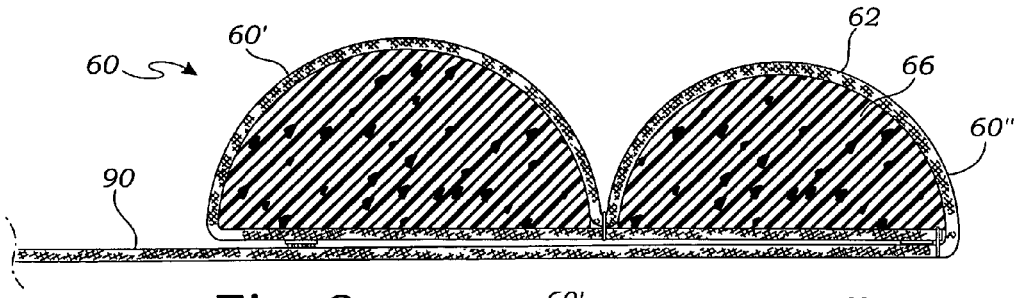
FIG. 8 is a section view taken along line 8—8 in FIG. 7 showing a pillow of the invention in a folded open attitude.
Figure 9:
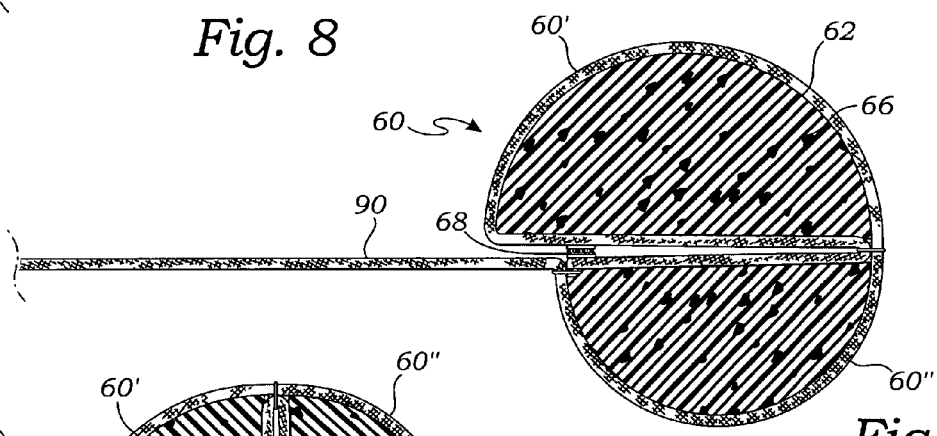
FIG. 9 is the section view of FIG. 8 showing the pillow in a folded closed attitude.
Figure 10:
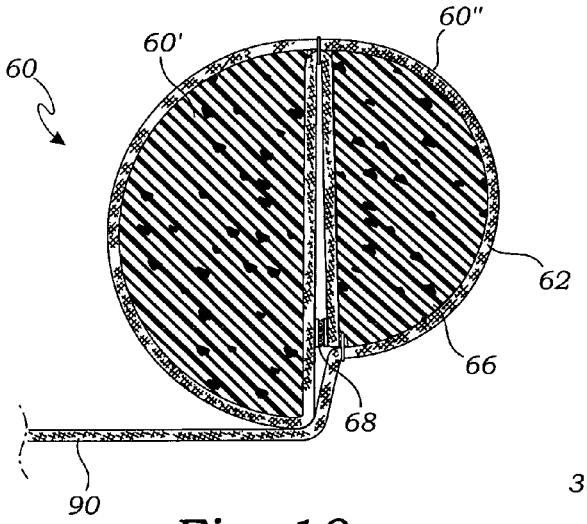
FIG. 10 is the section view of FIG. 9 showing an alternate attitude of the pillow.

In FIG. 7 we find that the corner holders may be pockets 50" instead of straps 50 for improved engagement with support 90. It is shown also, that pillow 60 is preferably split so that it may be opened up and laid onto the sheet 10 (FIG. 8), closed and positioned to extend beyond support 90 (FIG. 9), or closed and positioned over the end of support 90 (FIG. 10). In FIGS. 8–10 we see that the pillow 60 is preferably split in uneven portions with the portion to the left in FIG. 8, 60' being the larger and the portion to the right in FIG. 8, 60" being the smaller. When the user lies on the pillow 60 as positioned in FIG. 8, the larger portion 60' supports the neck of the user, while the portion 60" supports the head of the user, and this relationship is advantageous to the user as it supports the neck and head in a natural manner. The two portions 60' and 60" are able to be folded together and joined using hook and loop material fasteners for instance, as shown. FIG. 10 shows the pillow 60 of FIG. 9 oriented in an alternate attitude. Clearly, sleeve 62 for the pillow 60 may be a continuation of the fabric of sheet 10, or may be formed from a separate length of cloth with the sheet 10 attached separately as shown in FIGS. 8–10.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A combination apparatus for engaging a person in a reclined position, the apparatus comprising: a flexible fabric sheet providing corner holders mounted at corners of the sheet; a horizontally oriented support engaged with the corner holders for securing the sheet thereon; and a pillow having a curved fabric outer cover, the pillow split into two portions sharing the outer cover; each one of the portions providing a planar fabric inner panel, the two portions sharing a common edge functional as a hinge enabling the two portions to assume an unfolded attitude wherein the inner panels lie in a common plane, and a folded attitude wherein the inner panels mutually abut.

2. The apparatus of claim 1 wherein the portions of the pillow are of unequal size.

3. The apparatus of claim 1 wherein the corner holders are at least one of diagonally oriented straps and diagonally oriented pockets.

4. The apparatus of claim 1 further comprising a blanket laterally contiguous with the sheet.

5. The apparatus of claim 1 wherein the outer cover of the pillow is contiguous with the sheet.

6. The apparatus of claim 1 wherein the sheet is folded to express a sheet width approximating a width of the pillow and the sheet is rolled about the pillow forming a coiled bundle, the sheet providing at least one securement band at a location for encircling the coiled bundle.

7. The apparatus of claim 6 further comprising a back pack carrier enclosing the coiled and secured bundle and conforming in shape thereto, the back pack providing shoulder straps for mounting the back pack carrier on a person's back.

8. A combination apparatus for engaging a person in a reclined position, the apparatus comprising: a flexible fabric sheet providing corner holders mounted at corners of the sheet; and a pillow having a curved fabric outer cover, the pillow split into two portions sharing the outer cover; each one of the portions providing a planar fabric inner panel, the two portions sharing a common edge functional as a hinge enabling the two portions to assume an unfolded attitude wherein the inner panels lie in a common plane, and a folded attitude wherein the inner panels mutually abut.

9. The apparatus of claim 8 wherein the portions of the pillow are of unequal size.

10. The apparatus of claim 8 further comprising a horizontally oriented support engaged with the corner holders for securing the sheet thereon.

11. The apparatus of claim 8 wherein the corner holders are at least one of diagonally oriented straps and diagonally oriented pockets.

12. The apparatus of claim 8 further comprising a blanket laterally contiguous with the sheet.

13. The apparatus of claim 8 wherein the outer cover is contiguous with the sheet.

14. The apparatus of claim 8 wherein the sheet is folded to express a sheet width approximating a width of the pillow and the sheet is rolled about the pillow forming a coiled bundle, the sheet providing at least one securement band at a location for encircling the coiled bundle.

15. The apparatus of claim 14 further comprising a back pack carrier enclosing the coiled and secured bundle and conforming in shape thereto, the back pack providing shoulder straps for mounting the back pack carrier on a person's back.

16. A method for engaging a person in a reclined position, the method comprising the steps of: mounting corner holders on corners of a flexible fabric sheet; engaging a horizontally oriented support with the corner holders thereby securing the sheet thereon; forming a pillow having a curved fabric outer cover; splitting the pillow into two portions sharing the outer cover; providing a planar fabric inner panel on each of the portions, the two portions sharing a common edge functional as a hinge; moving the portions of the pillow between an unfolded attitude wherein the inner panels lie in a common plane, and a folded attitude wherein the inner panels mutually abut.

17. The method of claim 16 comprising the further step of forming the portions of the pillow with unequal size.

18. The method of claim 16 comprising the further step of engaging a blanket laterally contiguous with the sheet.

19. The method of claim 16 comprising the further step of engaging the outer cover of the pillow contiguously with the sheet.

20. The method of claim 16 comprising the further steps of: folding the sheet to express a sheet width approximating a width of the pillow; rolling the sheet about the pillow to form a coiled bundle; attaching at least one securement band to the sheet; encircling the coiled bundle with the at least one securement band, and placing the coiled bundle within a back pack for carrying the coiled bundle on a person's back.

* * * * *